US012351274B2

(12) United States Patent
Pollen et al.

(10) Patent No.: US 12,351,274 B2
(45) Date of Patent: Jul. 8, 2025

(54) STRUT ACTUATED BIMINI TOP

(71) Applicants: Randall P. Pollen, Milford, IN (US); Cory Kuhl, Syracuse, IN (US)

(72) Inventors: Randall P. Pollen, Milford, IN (US); Cory Kuhl, Syracuse, IN (US)

( * ) Notice: Subject to any disclaimer, the term of this patent is extended or adjusted under 35 U.S.C. 154(b) by 0 days.

(21) Appl. No.: 18/818,091

(22) Filed: Aug. 28, 2024

(65) Prior Publication Data

US 2025/0074549 A1 Mar. 6, 2025

Related U.S. Application Data

(60) Provisional application No. 63/580,079, filed on Sep. 1, 2023.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02; B63B 17/04
USPC ..... 114/361
See application file for complete search history.

(56) References Cited

U.S. PATENT DOCUMENTS 6,983,716 B1 * 1/2006 Ankney ..... B63B 17/02 114/361
7,389,737 B1 6/2008 Schwindaman

* cited by examiner

*Primary Examiner* — Lars A Olson
(74) *Attorney, Agent, or Firm* — Botkin & Hall, LLP; Michael D. Marston

(57) ABSTRACT

A bimini top having first second and third frame members. Each having a first end opposite a canopy support. The second frame member is pivotally connected to the first frame member between a pivotal connection of the first frame member and its canopy support. The third frame member is pivotally connected to the first frame member between the pivotal connection of first frame member and the pivotal connection of the second frame member to the first frame member. A flexible canopy is connected to the canopy supports of the first second and third frame members. An actuator pulls on the third frame member to move the frame members from a stored position locating them relatively near each other to a use position locating the canopy supports spread apart from the stored position.

14 Claims, 12 Drawing Sheets

STRUT ACTUATED BIMINI TOP

CROSS REFERENCE TO RELATED APPLICATIONS

This non-provisional patent application claims priority to U.S. Provisional Patent Application Ser. No. 63/580,079, filed Sep. 1, 2023, and is hereby incorporated in its entirety by reference.

BACKGROUND OF THE INVENTION

Bimini tops are a highly useful and important boating accessory and as such there are many available options. Manual bimini tops are a workable solution, but require involvement and effort of the operator that detracts from a relaxing boating experience. Therefore, automatic bimini tops have become a popular option that allows boaters to avoid the effort of manually actuating their tops from a stored position to a use position. Additionally, automatic bimini tops require no particular skill or knowledge of manipulating moving parts or fastening parts to each other within a manual bimini top.

Earlier bimini tops have had complex mechanisms that are either expensive to machine or may include pinch points. An example is shown in U.S. Pat. No. 7,389,737 in which a geared mechanism is used from the base of a bimini top to actuate the entire top. This system includes a gear and a rack, both of which are relatively expensive parts to make. Additionally, this type of mechanism is subject to large forces as the entire length of bimini top supports may exert leverage on the gear actuation mechanism that is located at the bottom of the bimini top. As such, the actuation mechanism must include multiple complicated parts to prevent the forces on the top from back driving the actuating mechanism that must endure stress from the leverage of the entire bimini top. There remains a need for a bimini top that provides a relatively simple and robust mechanism that is safe from pinch points within the mechanism.

SUMMARY OF THE INVENTION

The present invention has a first frame member having a first end pivotally connected to a first mounting bracket. The first frame member has a canopy support that is opposite to the first end. The first frame member is movable between a stored position and a use position. Movement of the first frame member from the stored position to the use position is in a forward direction. A second frame member is pivotally connected to the first frame member at a location between the first end of the first frame member and said canopy support of said first frame member. The second frame member has a canopy support that is opposite to its pivotal connection to the first frame member. The second frame member is movable between a stored position and a use position. The stored position locates the second frame member relatively near to the first frame member and the use position locates the second frame member relatively far from the first frame member. Movement of the second frame member from the stored position to the use position corresponds to rotation of the second frame member in the forward direction of rotation. A third frame member is pivotally connected to the first frame member at a location between the first end of the first frame member and the pivotal connection of the second frame member.

An actuator is connected to the third frame member. The actuator has a first end that that is pivotally connected to a fixed location with respect to the pivotal connection of the first frame member to the first mounting bracket. The actuator has a second end that is pivotally connected to the third frame member at a location spaced from the pivotal connection of the third frame member to the first frame member. The actuator is movable between a retracted position and an extended position. The extended position of the actuator corresponds to the stored position of the first second and third frame members.

A flexible member connects the first second and third frame members. That flexible member may be a canopy.

DETAILED DESCRIPTION OF THE INVENTION

Figure 1:
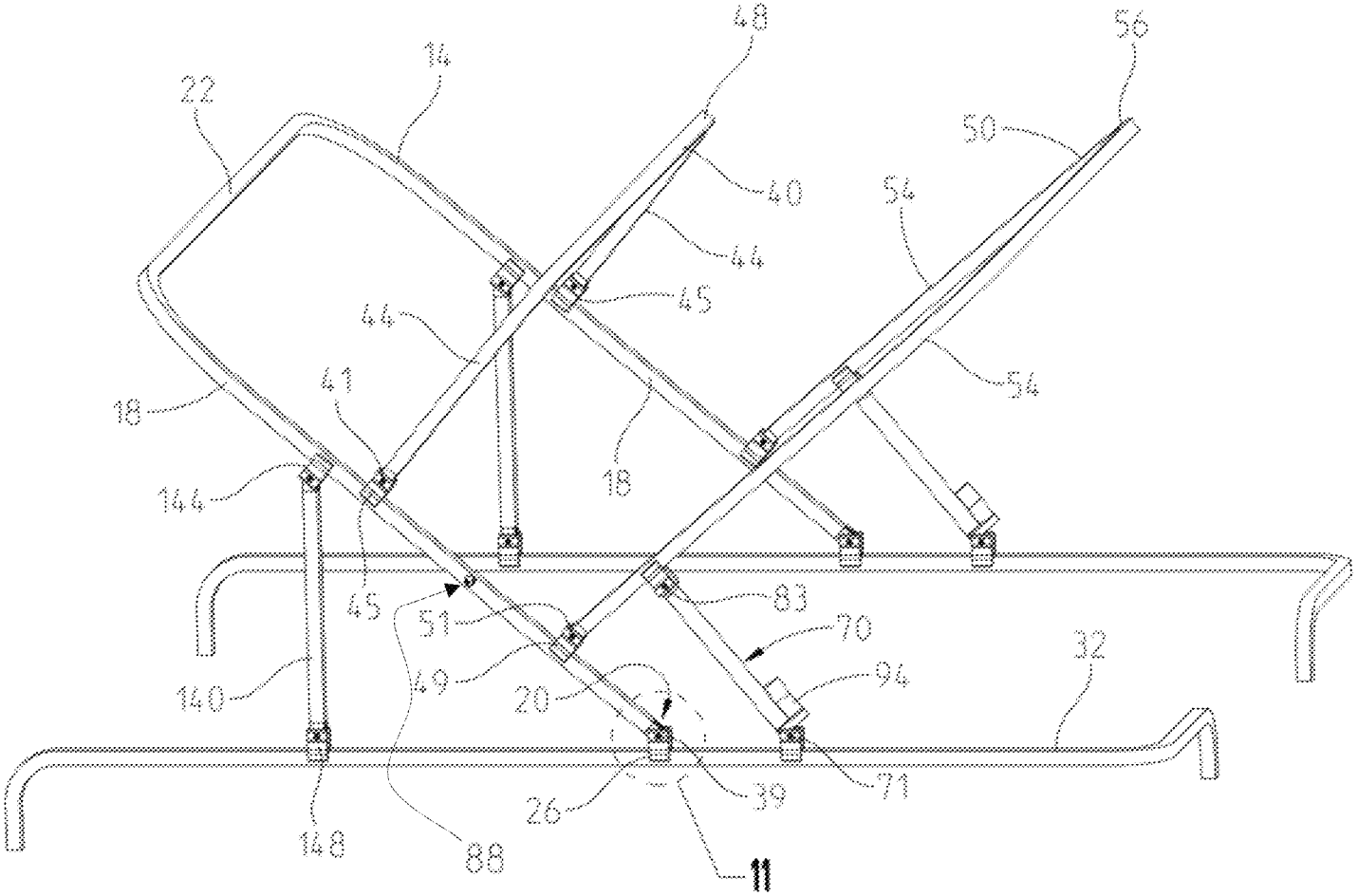
FIG. 1 is an isometric view of the frame bows without the canopy installed in the use position.
Figure 2:
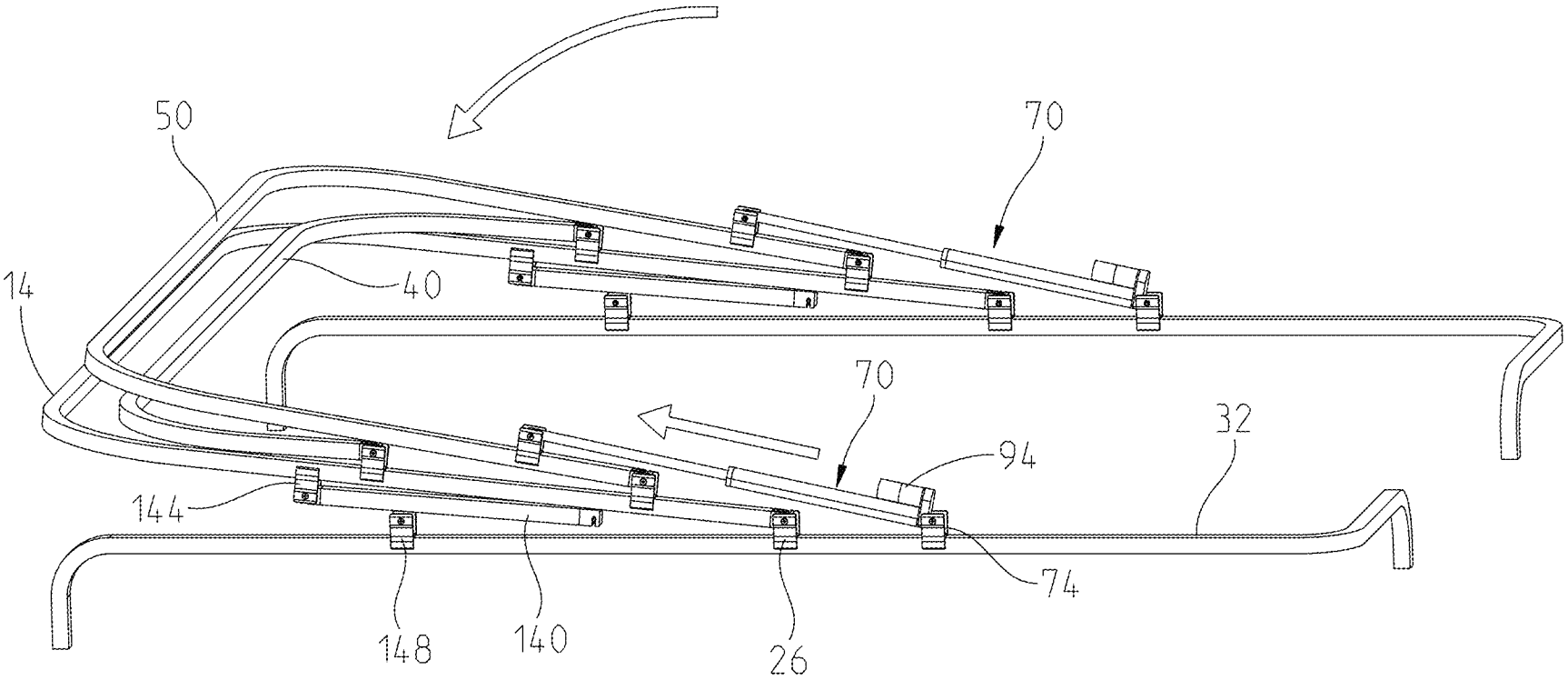
FIG. 2 is an isometric view of the frame bows in FIG. 1 showing the stored position.
Figure 3:
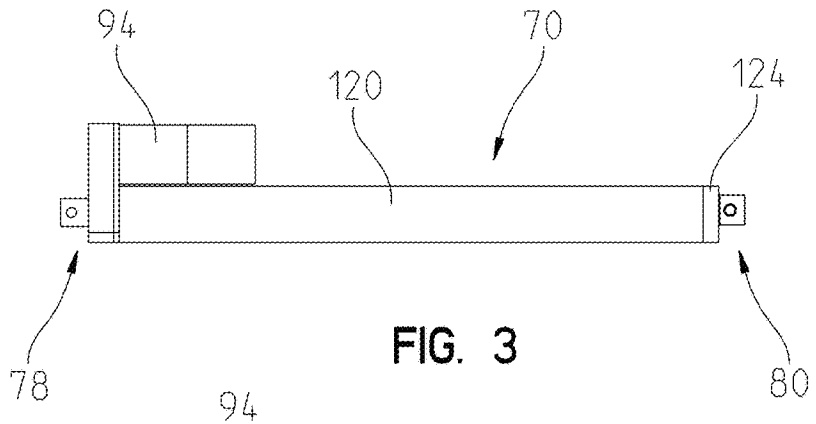
FIG. 3 is a side view of the actuator shown in FIGS. 1 and 2 in its retracted position.
Figure 4:
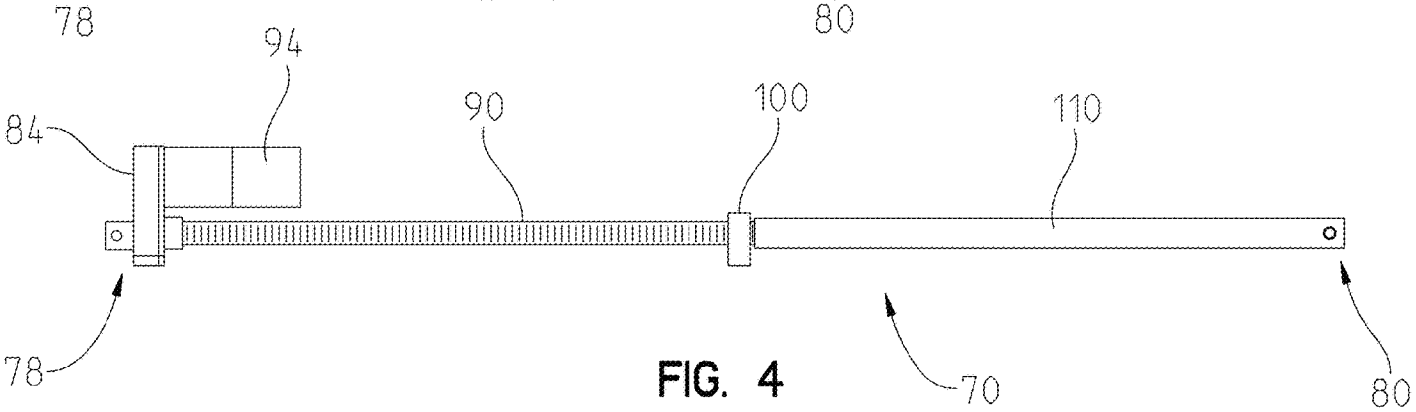
FIG. 4 is a side view of the actuator shown in FIGS. 1-3 in its extended position with some parts not shown so that the screw is visible.
Figure 5:
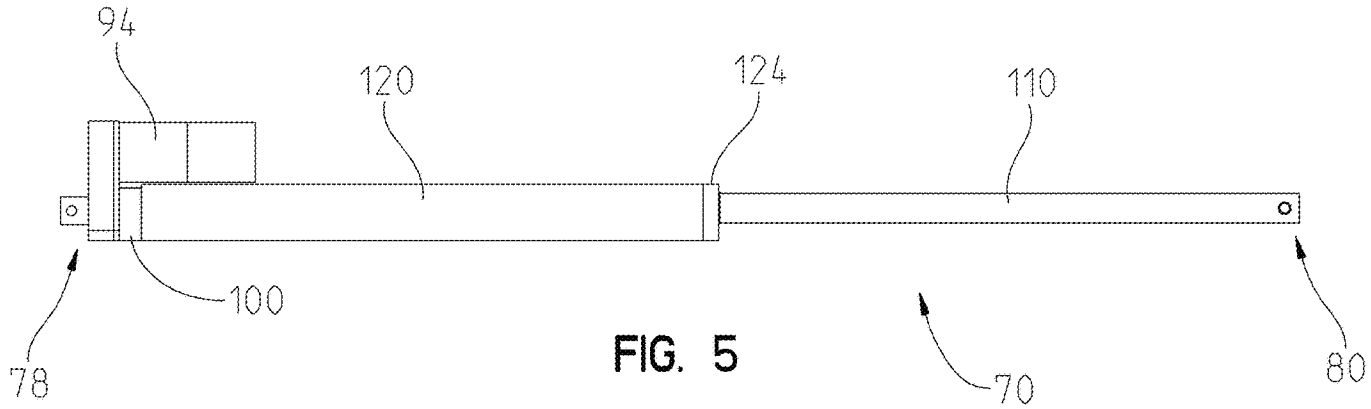
FIG. 5 is a side view of the actuator shown in FIGS. 1-4 in its extended position with all parts intact.

FIG. 1 is an overview of the bimini top 10 of the present invention. The bimini top 10 has a first frame bow 14 having a pair of upright supports 18 that are connected to a canopy support 22 that spans between the upright supports 18. The first frame bow 14 and other parts of the bimini top 10 to be described herein may be made of multiple pieces or a single extrusion. In the case of the first frame bow 14 shown in FIG. 1, it is made from a single extrusion bent to form the upright supports 18 and canopy support 22 from a single piece. Each upright support 18 within the frame bow 14 has a first end 20 that is pivotally connected to first mounting brackets 26. The first mounting bracket 26 is mounted to the structure of a boat. In FIG. 1 that structure is a rail 32 of the boat, but could be a gunwale or any other part of a boat to which the bimini top 10 may be attached. Each first mounting bracket 26 has a base 34 and upright walls 36 that hold a rod 38 about which the first ends 20 of the upright supports 18 pivot about. The rod 38 may be a bolt or may be a bolt with a sleeve over it to cover the threads. The upright walls 36 allow for pivotal movement of the entire first frame bow 14 about the rod 38 and restrain lateral movement of the frame bow 14. Thus, the center of rod 38 serves as a first pivot point 39 about which the entire bimini top 10 may pivot about. The first frame bow 14 is movable between a stored position shown in FIG. 2, and a use position shown in FIG. 1. The stored position locates the first frame bow 14 near the boat, or directly adjacent to the rail 32. The first frame bow 14 is rotated in a forward direction of rotation as it moves from its stored position shown in FIG. 2 to its use position shown in FIG. 1. The forward direction of rotation corresponds to a clockwise direction, as shown in FIGS. 1 and 2.

A second frame bow 40 is pivotally connected to the first frame bow 14. The second frame bow 40 has a pair of upright supports 44 that are connected to a canopy support 48. The canopy support 48 spans between the upright supports 44. The upright supports 44 of the second frame bow 40 are pivotally connected to the upright supports 18 of the first frame bow 14 with mounting brackets 45. The mounting brackets 45 define the pivotal connection for the second frame bow 40. That pivotal location is located between the pivotal connection provided by the first mounting bracket 26 and the canopy support 22 of the first frame bow 14. Mounting brackets 45 that function in a similar manner to the first mounting brackets 26. The second frame bow 40 pivots about a second pivot point 41 which is located between first pivot point 39 and canopy support 22. The second frame bow 40 is movable between a stored position shown in FIG. 2 to a use position that is shown in FIG. 1. The stored position of the second frame bow 40 locates it adjacent to and relatively near the first frame bow 14. The use position of the second frame bow 40 locates it at a relatively far distance from the first frame bow 14. Movement from the stored position to the use position is in the forward direction of rotation which, as stated above, is in the clockwise direction. This is viewed in FIGS. 1 and 2. It should be noted that both the first frame bow 14 and the second frame bow 40 rotate in the same forward direction of rotation to move from their respective stored positions to their respective use positions.

A third frame bow 50 is pivotally connected to the first frame bow 14 with mounting brackets 49 at a location between the first ends 20 on the upright supports 18 and mounting brackets 45 that define the pivotally connected location of the second frame bow 40 on the upright supports 18. Mounting brackets 49 define the pivotal connection of the third frame bow 50 to the first frame bow 14. The third frame bow 50 pivots about third pivot point 51 and third pivot point 51 is between first pivot point 39 and second pivot point 41. The third frame bow 50 has upright supports 54 and a canopy support 56. The upright supports 54 of the third frame bow 50 are longer than the upright supports 44 on the second frame bow 40. This is because the third frame bow 50 is mounted on the first frame bow 14 nearer first pivot point 39, which is pivotal connection of the first frame bow 14 within the first mounting bracket 26. In other words, the pivotal mounting location of the third frame bow 50 at mounting brackets 49 on the first frame bow 14 is lower than the pivotal connection of the second frame bow 40 to the first frame bow 14 at mounting brackets 45. The canopy supports 22, 48, 56 are located at a substantially similar height above the rail 32 of the boat when each of the frame bows 14, 40, 50 are in their respective use positions.

Figure 10:
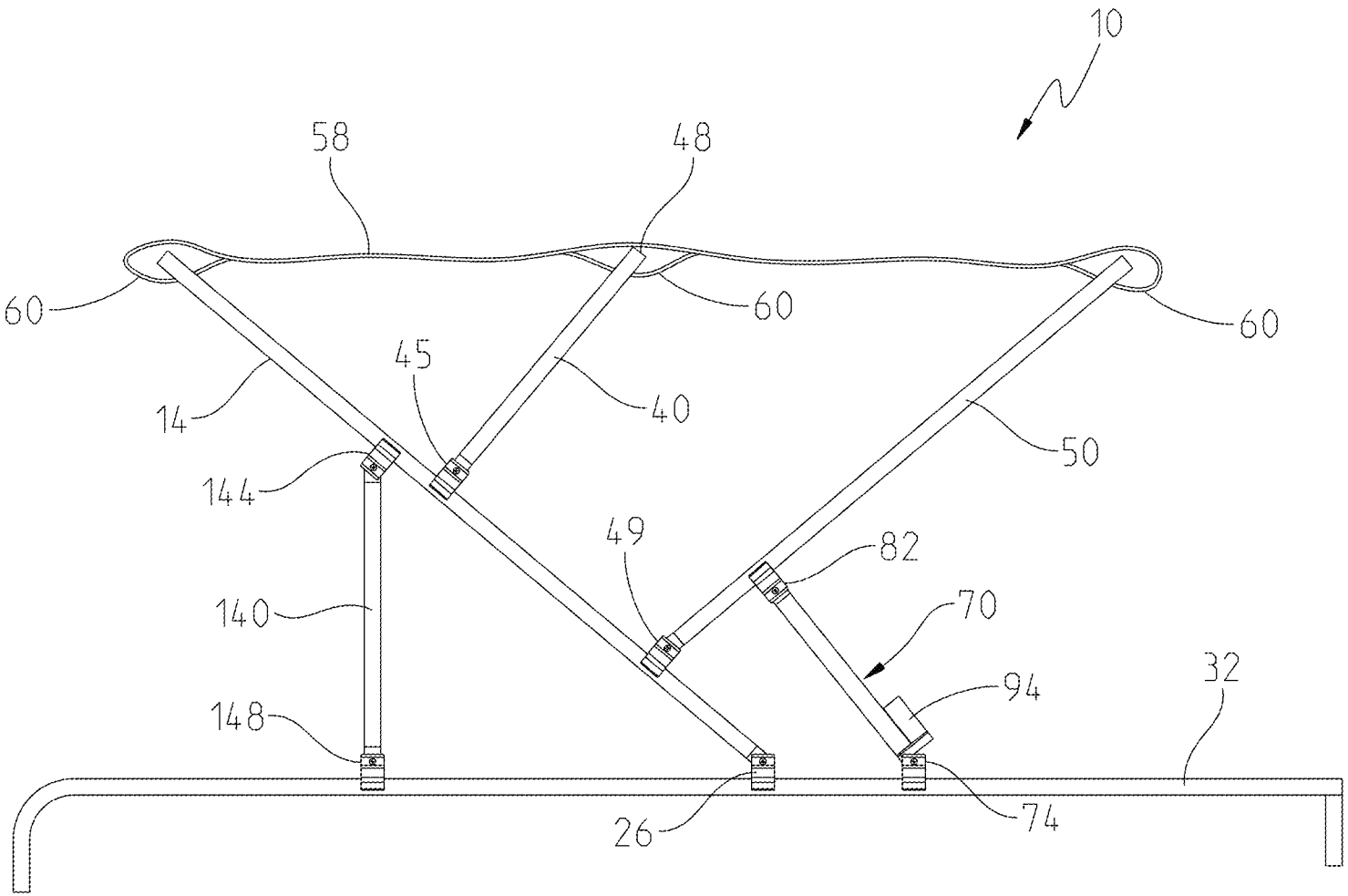
FIG. 10 is a side view of the frame bows shown in FIGS. 1 and 2 in the use position with the canopy installed.
Figure 11:
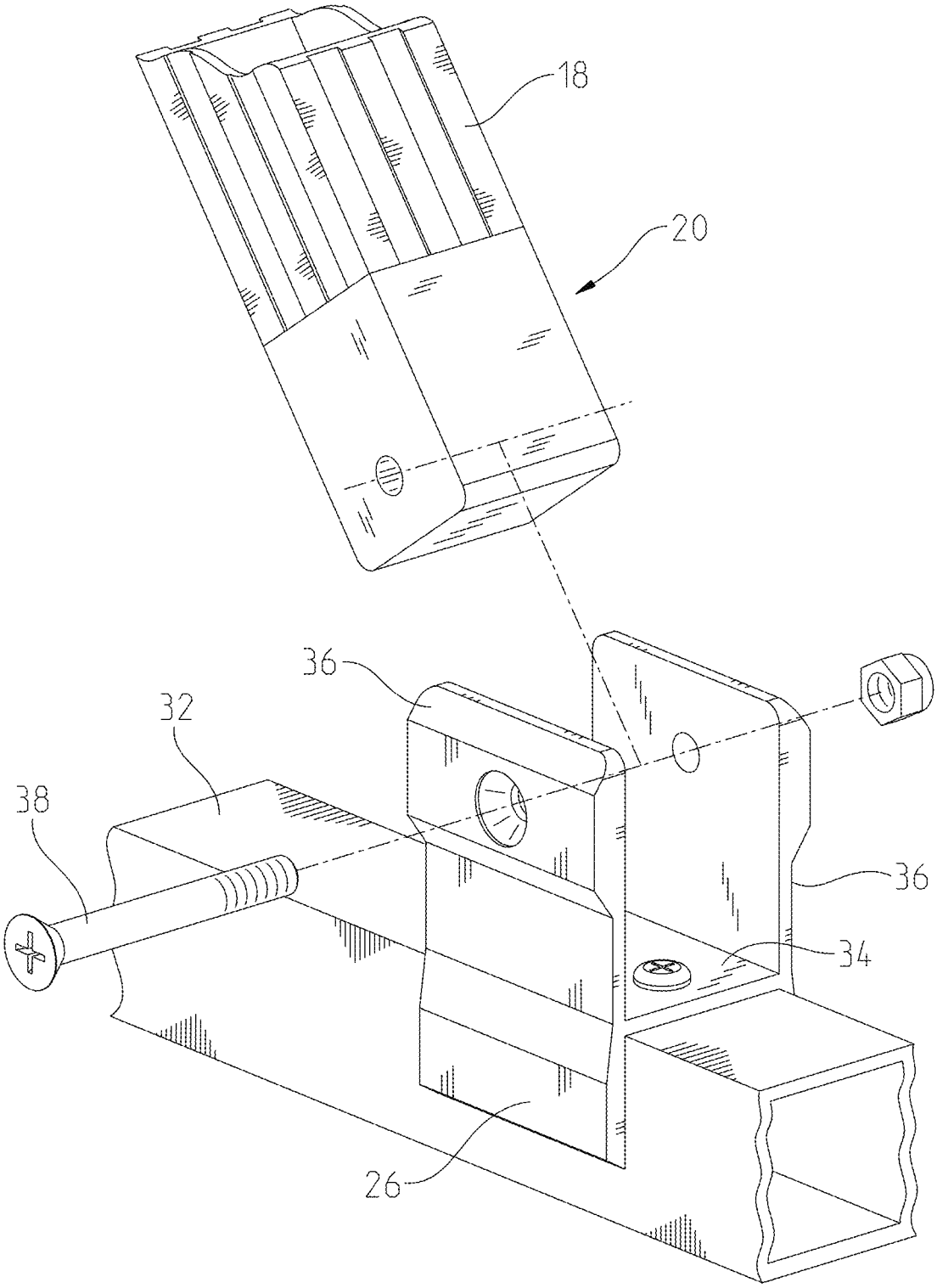
FIG. 11 is the first mounting bracket from area 11 as shown in FIG. 1 in an exploded view.
Figure 12:
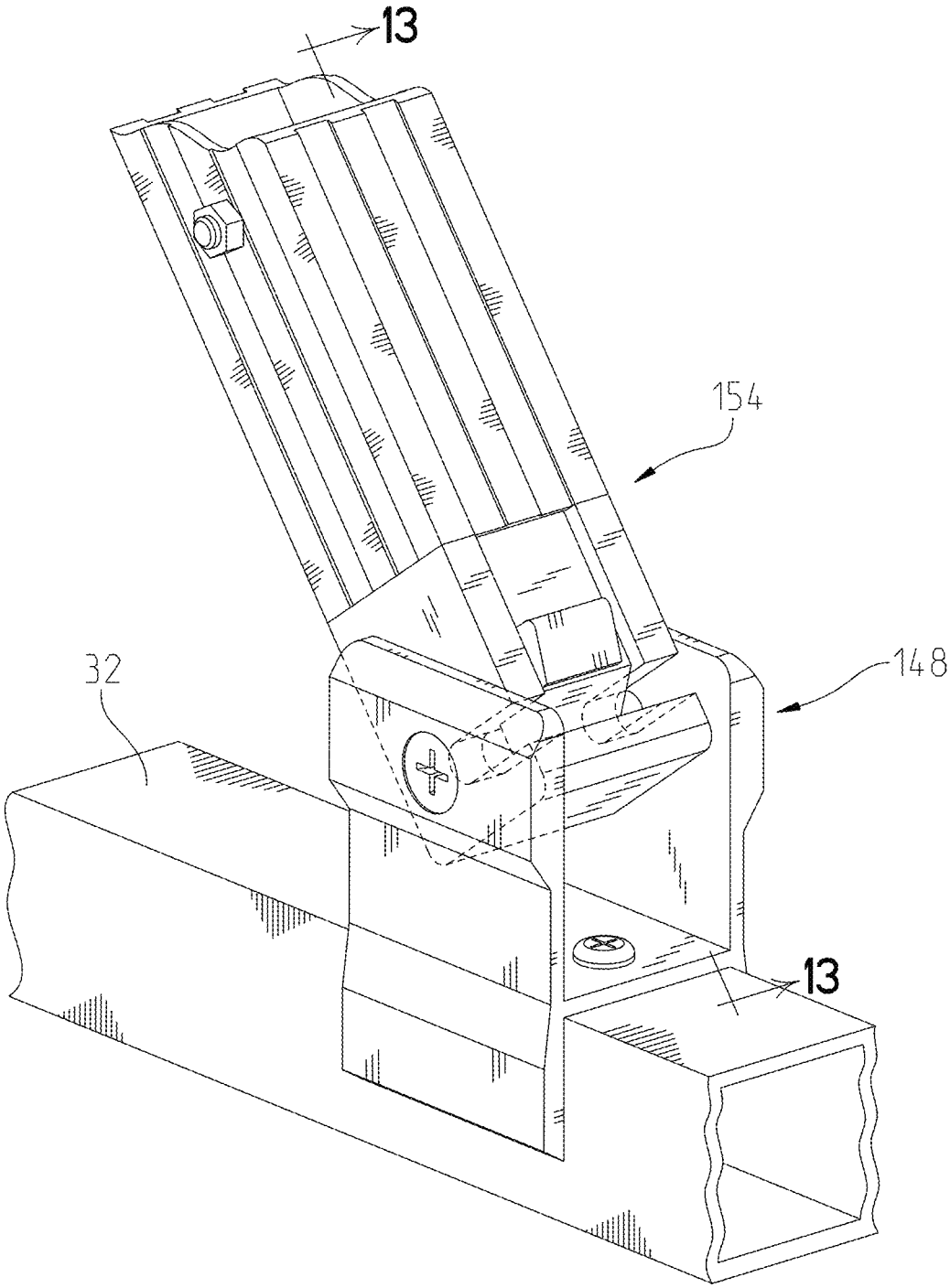
FIG. 12 is the latch of the safety strut in the locked position.

Each of the frame bows 14, 40, 50 are connected together with a canopy 58 that serves as a connective flexible fabric and covers the boat when the bimini top 10 is in its use position. The canopy 58 serving as a cover for the boat is shown in FIG. 10 and this corresponds to each of the frame bows 14, 40, 50 being in their use positions. The configuration shown in FIG. 10 corresponds to the use position of the bimini top 10 as a whole. The canopy 58 has pockets 60 that surround their respective canopy supports 22, 48, 56 of each frame bow 14, 40, 50. The canopy pockets 60 can be sewn around the canopy supports 22, 48, 56 so that they capture each canopy support 22, 48, 56 or the pockets 60 may contain a zipper that allows removal and replacement of the entire canopy 58. The configuration of the canopy 58 having pockets 60 surrounding the canopy supports 22, 48, 56 allows the canopy 58 to act as transmission to facilitate coordinated movement between the frame bows 14, 40, 50 so their movements occur in a coordinated manner that will be described below. The canopy 58 is the only transmission that connects the third frame bow 50 to the other two, and the canopy 58 may be used to drive the movement of the other two frame bows 14, 40.

An actuator 70 is connected to the third frame bow 50 and the rail 32 of the boat. The actuator 70 is pivotally connected to the rail 32 with a mounting bracket 74 at a first end 78 of the actuator 70 and a second end 80 of the actuator 70 is connected to a mounting bracket 82 on the third frame bow 50. Pivot point 71 is the location about which the first end 78 of the actuator 70 pivots with respect to the rail 32. Pivot point 71 and pivot point 39 may be located in a single bracket instead of separately, as shown in FIGS. 1, 2, and 10. The pivotal connection of the actuator 70 to the third frame bow 50 at mounting bracket 82, which is pivot point 83, is spaced from the pivotal point 51 defined by the mounting brackets 49 that mount third frame bow 50 to the first frame bow 14. Pivot point 71 is fixed with respect to first pivot point 39. This is shown in FIG. 10. Pivot point 71 for the first end 78 of the actuator 70 is spaced from first pivot point 39 within mounting bracket 26 that defines the pivotal connection of the first frame bow 14 to the rail 32 of the boat. Although pivot point 71 and first pivot point 39 are shown in two separate mounting brackets 74, 26, a single mounting bracket may be used to contain both pivot points 39, 71. The amount of spacing the actuator 70 has from the other pivot points defined by mounting brackets 26, 49 is chosen to accommodate the particular actuator 70 and the size of the entire bimini top 10. Both pivot points 39, 71 remain fixed with respect to each other.

Figure 6:
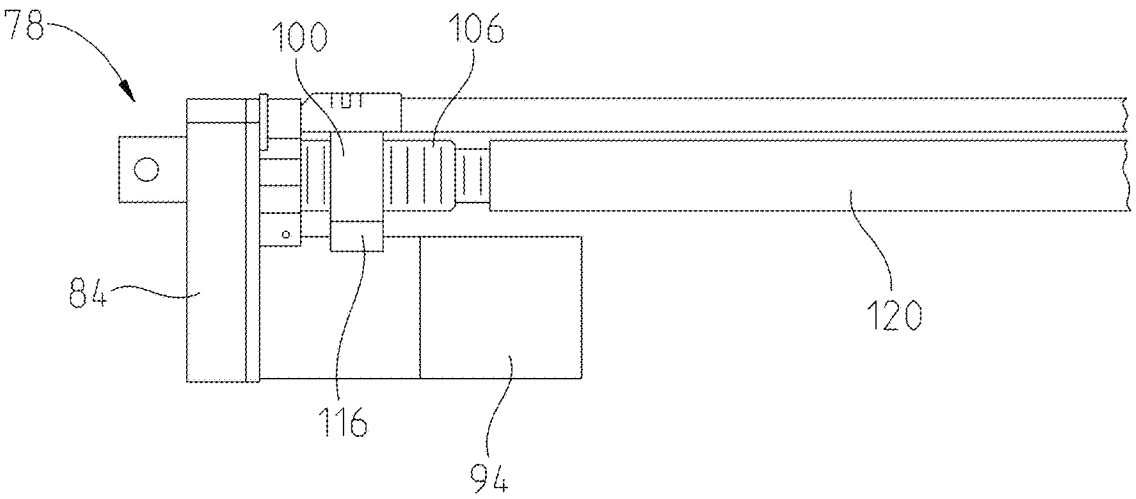
FIG. 6 is a side view of the actuator shown in FIGS. 1-5 near the motor.
Figure 7:
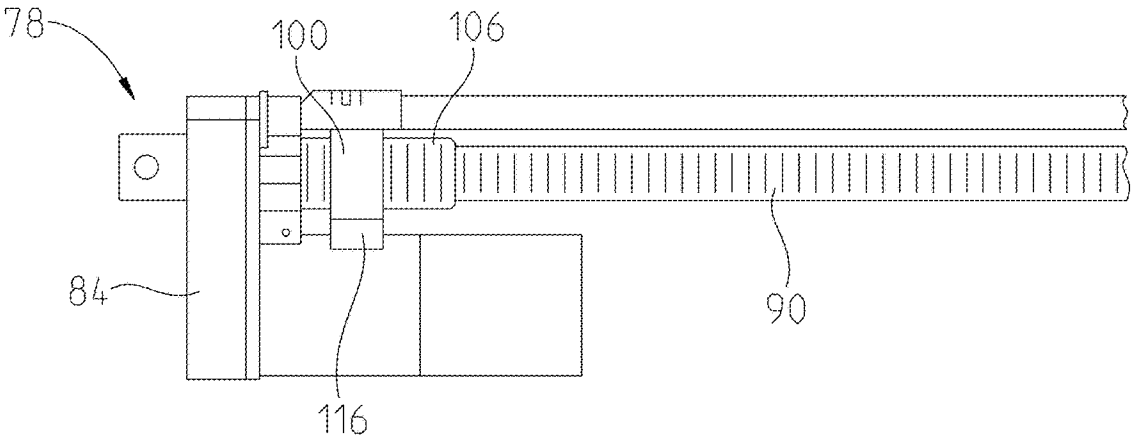
FIG. 7 is a side view of the actuator shown in FIGS. 1-6 near the motor; showing the screw.
Figure 8:
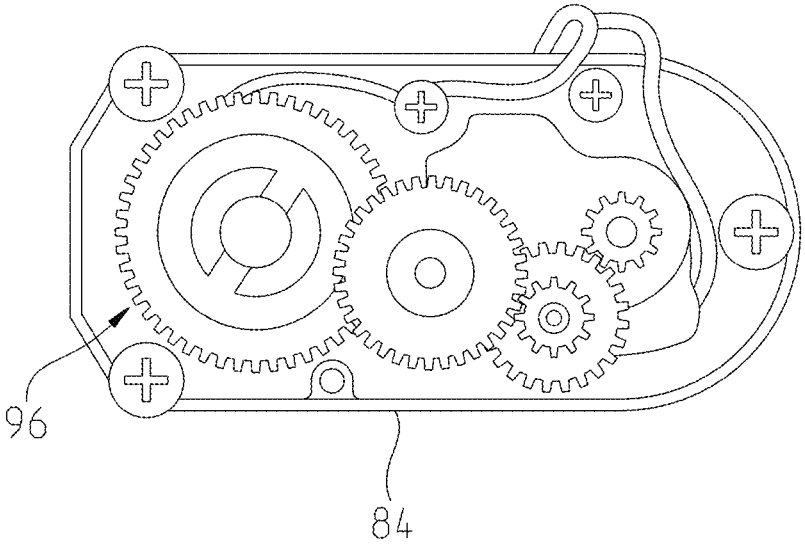
FIG. 8 is a top view of the gear reducing mechanism of the actuator shown in FIGS. 1-7.
Figure 9:
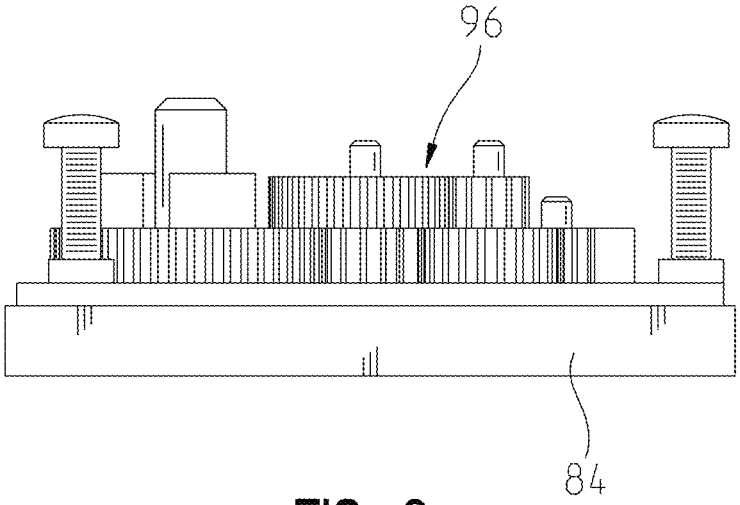
FIG. 9 is a side view of the gear reducing mechanism of the actuator shown in FIGS. 1-8.

The actuator 70 is movable between an extended position (shown in FIG. 1) and a retracted position (shown in FIG. 2). The actuator 70, as shown, is a screw driven type actuator 70. The actuator 70 has a base 84 at the first end 78 that holds a screw 90 and the base 84 restrains the screw 90 from axial movement with respect to the base 84 and allows the screw 90 to be rotated with a motor 94. The motor 94 is connected to the screw 90 through a gear reduction mechanism 96. The screw 90 mates with a threaded block 100 and rotation of the screw 90 provides a driving force for moving the threaded block 100 with respect to the base 84. The threaded block 100 has external threads 106 that mate with a screw sheath 110. The screw sheath 110 is a hollow cylindrical body that is long enough to cover the entire length of the screw 90 when the actuator 70 is in its fully retracted position, as shown in FIG. 6. The screw sheath 110 is shown unthreaded from the threaded block 100 in FIG. 6. The threaded block 100 has an anti-rotation feature 116 on its outer perimeter. The threaded block 100 fits within an outer sheath 120. The outer sheath 120 has an end cap 124 with a hole that slidingly holds the screw sheath 110. The outer sheath 120 is fixed to the base 84 and engages the anti-rotation feature 116 of the threaded block 100. As the threaded block 100 is restrained from rotation due to the complementary fit within the outer sheath 120, the threaded block 100 moves axially within the outer sheath 120 along the screw 90 as it rotates, and the entire screw sheath 110 moves through the end cap 124 rotation of the screw 90 causing axial movement of the threaded block 100. In this manner, the screw 90 is protected throughout its entire movement and there are no pinch points related to the screw 90 as the screw sheath 110 slides through the end cap 124. This also protects users from rotating parts which could entangle fingers or clothing. The motor 94 is reversible, and depending on which way the screw 90 turns, the threaded block 100 and screw sheath 110 move together in a desired direction. The screw 90 may turn until a limit switch stops the motor 94 at either the retracted position or the extended position. The screw 90 is chosen so that it cannot be back driven by forces acting on the actuator 70. As such, when the motor 94 stops at either the extended or retracted position, or any position in between, the actuator 70 will maintain its length under loads placed upon it.

When a user of the bimini top 10 wishes to move the top 10 from its stored position shown in FIG. 2 to the use position shown in FIG. 1, he will use a switch (not shown) that rotates the motor 94 in a direction that causes the screw 90 to shorten the actuator 70. As the actuator 70 moves from its extended position toward its retracted position, the third frame bow 50 is moved in a clockwise direction, as shown in FIGS. 1 and 2, which is also referred to as the forward direction of rotation. This forward direction of rotation is not movement with respect to the bow or stern of the boat, but the forward direction of rotation corresponds to the first and second frame bows 14, 40 rotating in a direction that locates them nearer to the actuator 70. The third frame bow 50 is rotated in the forward direction until the canopy 58 is taught enough that the pull of the canopy support 48 of the second frame bow 40 within the pocket 60 surrounds it. The pull of the third frame bow 50 on the second frame bow 40 causes the pocket 60 surrounding the canopy support 48 of the second frame bow 40 to rotate the second frame bow 40 in the forward direction of rotation. After the second frame bow 40 is rotated in the forward direction, the canopy 58 can pull on the first frame bow 14. When the tension on the canopy 58 is enough that the pocket 60 surrounding the canopy support 56 on the first frame bow 14 pulls upon the canopy support 56, the first frame bow 14 will be rotated in the forward direction of rotation. This will cause the first frame bow 14 to lift off of the rail 32. Once all of the frame bows 14, 40, 50 are rotated to their full extent in the forward direction of rotation, as shown in FIG. 1, the bimini top 10 is in its use position and the actuator 70 is in its retracted position. Movement of the bimini top 10 from the stored position to the use position happens in an orderly fashion. The canopy 58 acts as the only member transmitting force from the third frame bow 50, to the second frame bow 40, to the first frame bow 14. The construction of the bimini top 10 is such that the entire bimini top 10 pivots with respect to the boat about the first mounting bracket 26. It is contemplated that a fourth frame bow may be pivotally affixed to the first frame bow 14 between second pivot point 41 and canopy support 22 of the first frame bow 14. The first frame bow 14 is configured so that its center of gravity 88 is opposite the mounting bracket 74 for the actuator 70 and well offset from the mounting bracket 26 about which the bimini top 10 pivots about with respect to the boat. The location of the center of gravity 88 tends to rotate the first frame bow 14 in the opposite direction of the forward direction of rotation, or away from the actuator 70. This direction of rotation corresponds to counterclockwise, as shown in FIGS. 1 and 2. This location of the center of gravity 88 tends to rotate all the frame bows 14, 40, 50 in a counterclockwise direction and away from the actuator 70, as shown in FIGS. 1 and 2. This configuration of the center of gravity 88 provides some tension on the fabric of the canopy 58. Furthermore, the weight of the roof bows 40, 50 and the weight of the canopy 58 are offset from the mounting bracket 26 and opposite to the actuator 70, which also tends to rotate the first frame bow 14 in a counterclockwise direction as shown in FIGS. 1 and 2.

Once the bimini top 10 is in its use position, a safety strut 140 may be employed to secure the bimini top 10 in its use position. The safety strut 140 is pivotally connected to the first frame bow 14 with mounting bracket 144 and is releasably securable to a bracket 148 on the rail 32 of the boat. A latch 154 on the safety strut 140, opposite to the mounting bracket 144, provides the releasable connection to bracket 148. The position of the center of gravity 88 and its tendency to generate tension in the canopy 58 makes the bimini top 10 useable without the safety strut.

Figure 15:
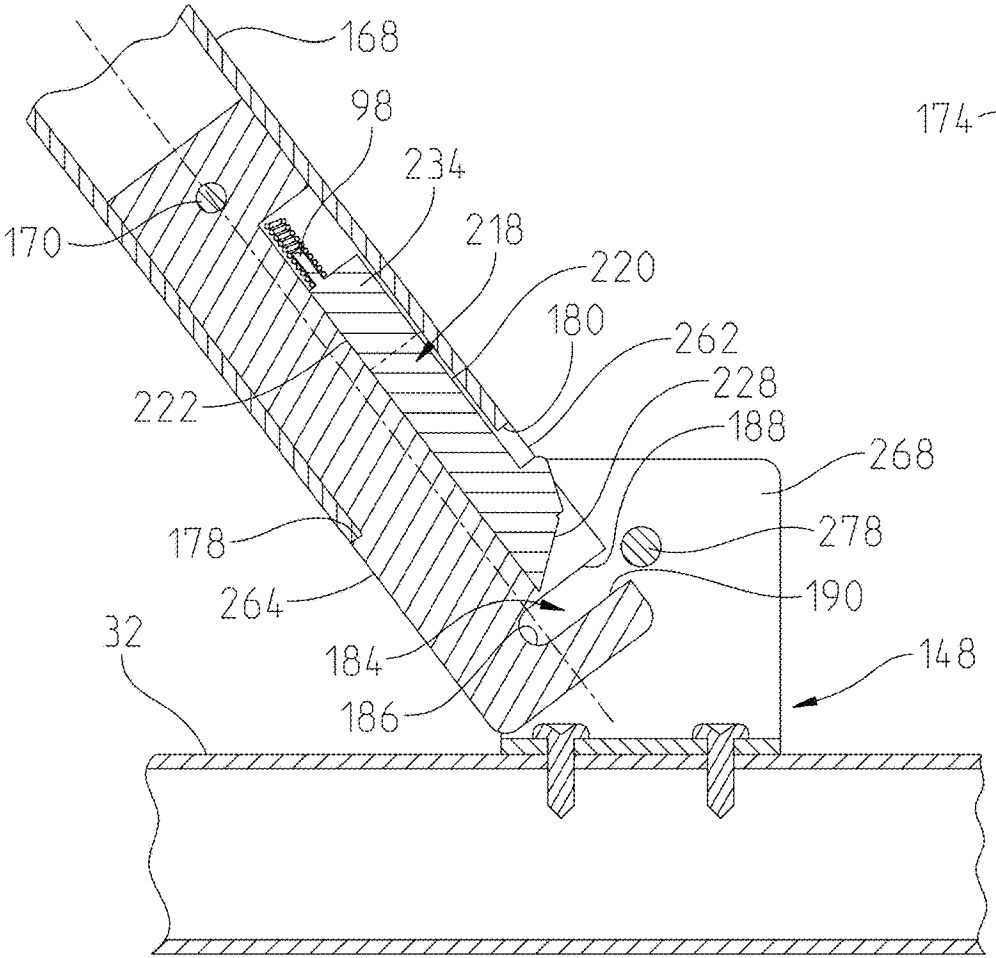
FIG. 15 is similar sectional view to FIG. 13 with the latch in its unlocked position.
Figure 17:
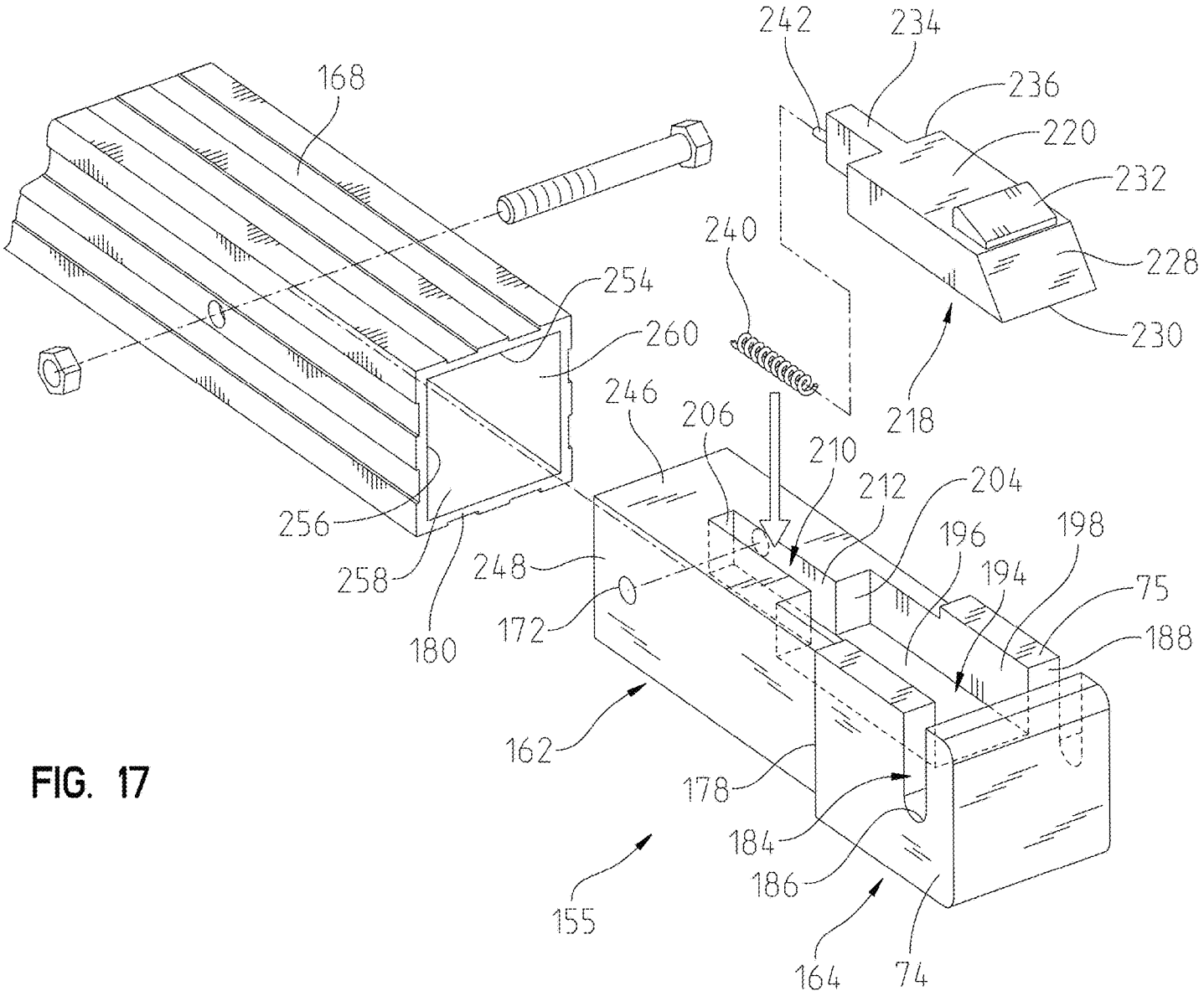
FIG. 17 is an exploded view of the latch shown in FIGS. 13-16.
Figure 18:
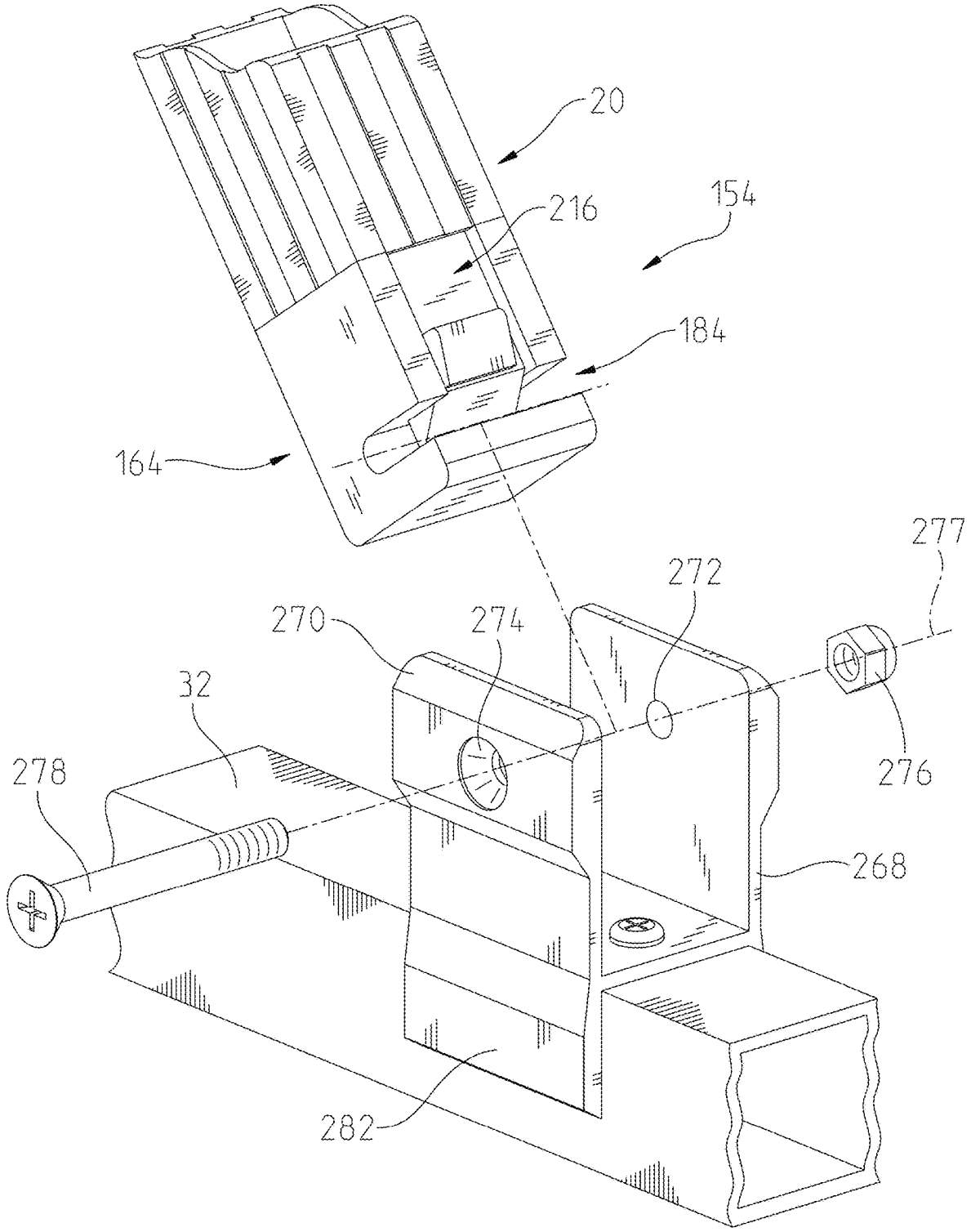
FIG. 18 is a disassembled view of the latch shown in FIGS. 13-17.

The latch 154 connects to bracket 148. The latch 154 has a main body 155 with a central axis 160 that has a tube portion 162 and a hook portion 164. The main body 155, in FIG. 17, is shown as formed from a single solid component that is machined, but it is contemplated that it can be die cast, molded, or assembled from several components. The tube portion 162 of the latch 154 resides inside the hollow tube 168 that makes up the safety strut 140 and the hook portion 164 remains exposed from the hollow tube 168. As shown in FIG. 15, the latch 154 is retained in the tube 168 with a bolt 170 that extends through the tube 168 and a retention aperture 172 in the tube portion 162. The bolt 170 is secured with a locknut 174. It is contemplated that main body 155 is secured to the tube 168 through riveting, threaded fasteners, welding, or crimping. A shoulder surface 178 divides the main body 155 into the tube portion 162 and the hook portion 164, and can abut a terminal edge 180 of the tube 168. The hook portion 164 includes a transverse notch 184 with a bottom surface 186. The transverse notch 184 has a close notch surface 188 and a far notch surface 190. As shown, the notch surfaces 188, 190 are parallel and face each other but it is contemplated that they may be angled with respect to each other.

The main body 155 has a catch trough 194 with a bottom surface 196. The catch trough 194 extends from the tube portion 162 to the hook portion 164, has sidewalls 198, 200 that extends between the transverse notch 184, and terminates at a backstop surface 204. The bottom surface 196 extends from a spring support surface 206 to the close notch surface 188. The catch trough 194 has a narrow area 210 with side surfaces 212 to define the width. The narrow area 210 terminates at the spring support surface 206.

Figure 14:
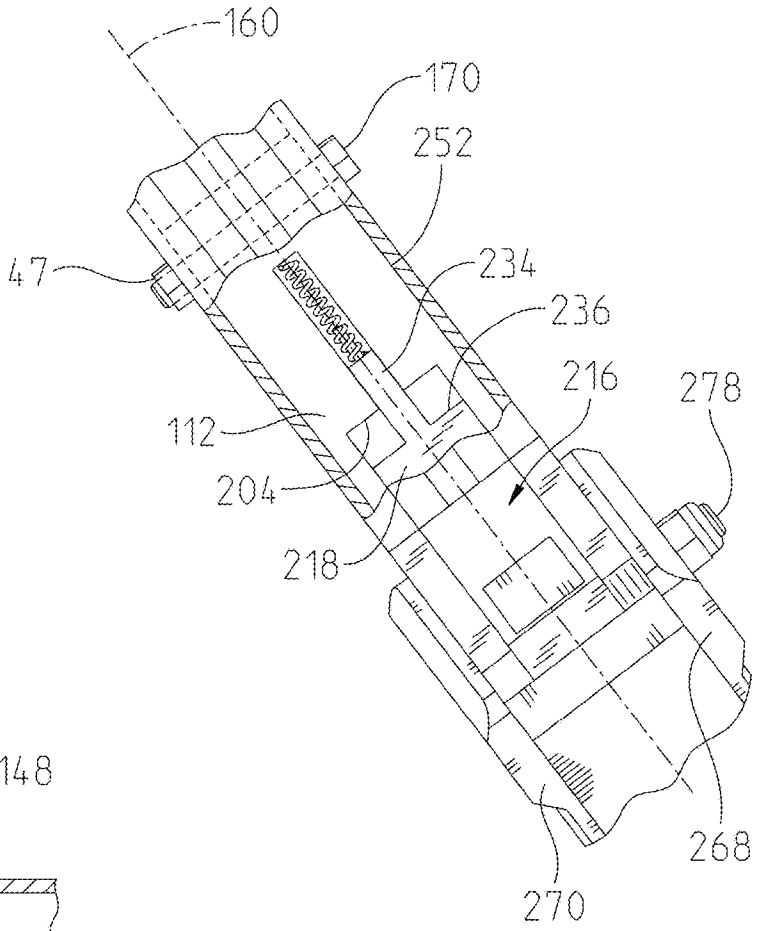
FIG. 14 is front view of the safety strut and latch shown in FIG. 13.
Figure 13:
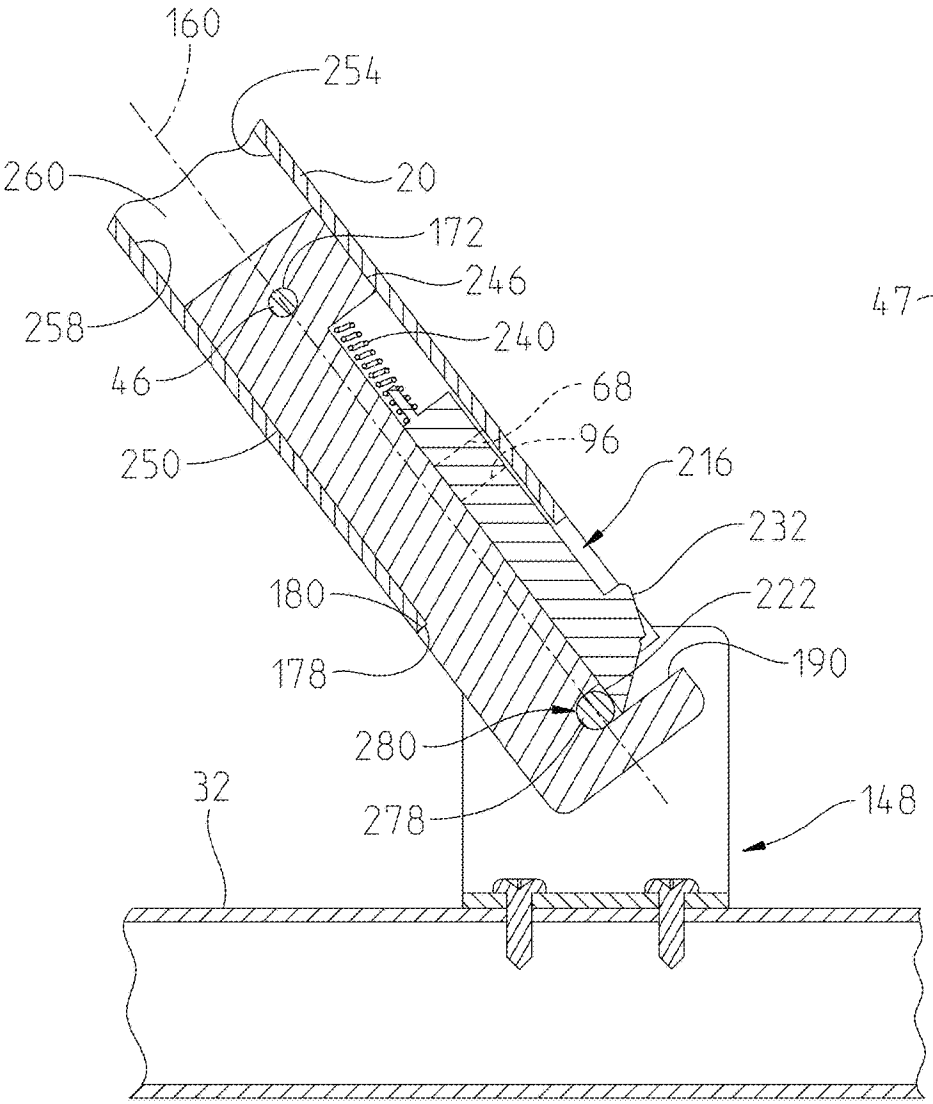
FIG. 13 is a sectional view of the safety strut and latch taken about line 13-13 in FIG. 12 in the locked position.
Figure 16:
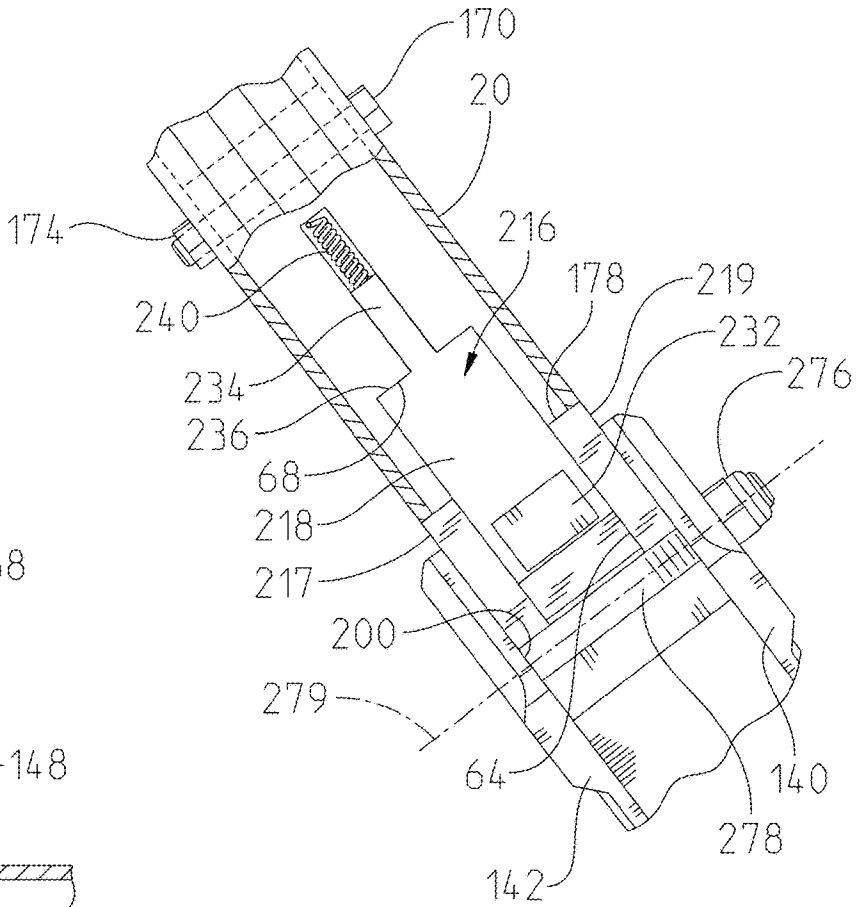
FIG. 16 is a front view of the safety struct and latch shown in FIG. 13-15 in the unlocked position.

A catch 216 resides in the catch trough 194 and slides between a locked and unlocked position. The locked position is shown in FIGS. 13 and 14, while the unlocked position is shown in FIGS. 15 and 16. The catch 216 has a chisel portion 218 with an outward facing surface 220 and an oppositely located inward facing surface 222. As shown, the surfaces 220, 222 are parallel, but it is contemplated that they could be angled with respect to each other. The surfaces 220, 222 define the thickness of the chisel portion 218, which is less than or equal to the depth of the catch trough 194. The chisel portion 218 has side surfaces 226 that define a width. The chisel portion 218 has a ramp surface 228 that terminates at a chisel edge 230. The ramp surface 228 faces outward and is located in the transverse notch 184 and mostly leaves the bottom of the transverse notch 184 unobstructed in the unlocked position. The chisel portion 218 includes a protruding grip surface 232. The protruding grip surface 232 provides a place for the user to place their finger or thumb to move the catch 216 between the locked and unlocked position. The catch 216 has a narrowed portion 234 with catch stop surfaces 236 between the chisel portion 218 and narrowed portion 234. The narrowed portion 234 has side surfaces 238 and fits within the narrow area 210 and the chisel portion 218 fits within the catch trough 194. The catch 216 is long to provide support and stability when it is in the locked position. Without sufficient length, outward forces exerted on the inward facing surface 222 could cause the catch 216 to move outwardly and allow the catch 216 to escape the catch trough 194.

A spring 240 resides in the narrow area 210 and is located between the spring support surface 206 and the narrowed portion 234. A spring support post 242 on the catch 216 along with the width of the narrow area 210 keeps the spring 240 in position. The spring 240 provides a biasing force to push the catch 216 towards the locked position, as shown in FIG. 14. In the locked position, the chisel edge 230 is in biased contact with the far notch surface 190 and part of the chisel portion 218 interrupts and blocks the transverse notch 184. The ramp surface 228 faces outwardly and opposite to the transverse notch 184. As assembled into the latch 154, the narrow area 210 and spring 240 are completely covered by the tube 168.

As assembled to the main body 155, the catch 218 slides between the locked position where the chisel edge 230 contacts the far notch surface 190. In the unlocked position, the catch stop surfaces 236 contact the backstop surfaces 204 and the chisel portion 218 is clear of the transverse notch 184, as shown in FIGS. 15 and 16. Without the tube 168 surrounding the tube portion 162, the catch 216 would be insufficiently constrained and could easily fall out of the catch trough 194. The outside surfaces 246, 248, 250, 252 of the tube portion 162 are surrounded by the inside surfaces 254, 256, 258, 260 of the tube 168. Assembly of the main body 155, catch 216, and spring 240 into the tube 168 completes the assembly of the latch 154. As assembled, the outward facing surface 220 will contact the inside surface 254 of the tube 168 to prevent the catch 216 and spring 240 from becoming separated from the main body 155. This is shown in FIGS. 13 and 15. The hook portion 164 has outside surfaces 217, 219 that define a width that closely matches the adjacent outside surfaces of the tube 168. This is shown on FIG. 17. The hook portion 164 further includes outside surfaces 262, 264 that closely matches corresponding outside surfaces of the tube 168.

The bracket 148 affixed to the rail 32 of the boat and has upstanding walls 268, 270. As shown, the upstanding walls 268, 270 are parallel, but it is contemplated that they may be angled with respect to each other. The upstanding walls 268, 270 have corresponding pin apertures 272, 274 that align on a pin axis 277. A pin 278 extends through the apertures 272, 274 and is secured to the walls 268, 270. Aperture 272 is shown as threaded and aperture 274 is shown as having a countersink feature, but this is not required. It is contemplated that one or both apertures 272, 274 are straight holes. It is further contemplated that the pin 278 is a rivet, shaft, or integral to the bracket 148. The pin 278 is also referred to as a hinge pin 278 because it provides a pivot axis for the latch 154. The walls 268, 270 are spaced apart to define a width. The width is wider than the width of the tube 168 and the hook portion 164. The pin 278 may include a locknut 276 to prevent the pin 278 from loosening due to vibration, temperature changes, or repeated latching and unlatching. The transverse notch 184 between the bottom of the transverse notch 184 and the inward facing surface 222 of the catch 216 forms a hinge pocket 280, shown in FIG. 15. The pin 278 is sized to fit in the hinge pocket 280 between the notch surfaces 188, 190. As shown in FIG. 15, the bracket 148 may be mounted to the rail 32 of the boat by any conventional method such as screws, or rivets. When the latch 154 is connected to the bracket 148, the central axis 160 intersects the pin axis 148. This allows the latch 154 and bracket 148 to act as a hinge where the latch 154 pivots about the pin axis 148.

To connect the latch 154 to the bracket 148, the user simply aligns the pin 278 with the opening of the transverse notch 184. The user moves the latch 154 toward the pin 278, where it contacts the ramp surface 228. The user then may manually retract the catch 216 with the grip surface 232 or allow the pin 278 to push the catch 216 towards the unlocked position with the ramp surface 228 transferring the force to move the catch 216 parallel to the central axis 160. By applying pressure to the ramp surface 228 with the pin 278, the latch 154 can be latched or connected to the bracket 148 by only applying force through pushing on the safety strut 140. The motion to connect the latch 154 to the bracket 148 is perpendicular to the central axis 160. As soon as the pin 278 passes the chisel edge 230, the spring 240 moves the catch 216 to the locked position and blocks the transverse notch 184. To disconnect the latch 154 from the bracket 148, the user presses on the grip surface 232 to move the catch 216 to the unlocked position where the user can move the latch 154 away from the pin 278, as shown in FIG. 13.

The latch 154 and bracket 148 provide a hinge by allowing the latch 154 to pivot about the pin 278 and pin axis 277 in the latched position. The width of the latch 154 between the upstanding walls 268, 270 prevents excessive movement of the latch 154 along the pin axis 277.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A bimini top comprising:

a first frame member having a first end pivotally connected to a first mounting bracket, said first frame member having a canopy support opposite said first end, said first frame member movable between a stored position and a use position, movement of said first frame member from said stored position to said use position being a forward direction of rotation;

a second frame member pivotally connected to said first frame member at a location between said first end of said first frame member and said canopy support of said first frame member, said second frame member having a canopy support opposite to said pivotal connection to said first frame member, said second frame member movable between a stored position in which said second frame member is at a first distance with respect to said first frame member and a use position in which said second frame member at a second distance with respect to said first frame member, said second distance being greater than said first distance, movement of said second frame member from said stored position to said use position corresponding to rotation of said second frame member in said forward direction of rotation;

a third frame member pivotally connected to said first frame member at a location between said first end of said first frame member and said pivotal connection of said second frame member, said third frame member having a canopy support opposite said pivotal connection to said first frame member, said third frame member movable between a stored position in which said third frame member is at a first distance with respect to said second frame member and a use position in which said third frame member is at a second distance with respect to said second frame member, said second distance being greater than said first distance, movement of said third frame member from said stored position to said use position corresponding to rotation of said third frame member in said forward direction of rotation;

an actuator including a screw rotatable within a base and restrained from axial movement, a threaded block engaging threads on said screw, an outer sheath connected to said base and said threaded block engaging said outer sheath to restrain said threaded block from rotation, said threaded block movable in axial sliding engagement with said outer sheath, rotation of said screw causing axial movement of said threaded block and movement of said actuator between a retracted and an extended position and a motor for rotating said screw, said actuator having a first end pivotally connected to a fixed location spaced from said pivotal connection of said first end of said first frame member to said first mounting bracket, said actuator having a second end pivotally connected to said third frame member at a location spaced from said pivotal connection of said third frame member to said first frame member, said actuator movable between a retracted position and an extended position, said extended position of said actuator corresponding to said stored position of said first, second, and third frame members wherein said first, second and third frame members are located at said first distances with respect to each other, said retracted position of said actuator corresponding to said use position of said first, second and third frame members; and a flexible connector connecting said first, second, and third frame members so that movement of said actuator from said extended position to retracted position pulls said second and third frame members into said use position.

2. The bimini top of claim 1, wherein said threaded block is connected to a screw sheath covering said screw, said threaded block and said screw sheath moving together as said threaded block moves along said screw.

3. The bimini top of claim 1, said flexible connector is a canopy wherein said canopy includes pockets surrounding said canopy supports.

4. The bimini top of claim 3, herein said first frame member has a center of gravity spaced from said first end in a location tending to rotate said first frame member away from said actuator.

5. The bimini top of claim 3, wherein said first frame member includes a selectively disconnectable safety strut having a first end pivotally connected to said first frame member between said first end and said canopy support on an opposite side of said first member with respect to said second and third frame members, said safety strut having a second end further comprising:

an elongate hollow frame tube having a terminal end;

a main body having a hook portion and a tube portion, said hook portion having a transverse notch extending therethrough and having a depth, said main body having a central axis, said main body having a catch trough having a bottom surface extending from said tube portion and terminating at said transverse notch, said tube portion located in said terminal end of said hollow frame tube and having a retaining aperture extending therethrough;

a catch received by said catch trough, said catch slidable within said catch trough in a direction parallel to said central axis between a locked position and an unlocked position, said locked position defined by said catch interrupting said catch trough, said unlocked position defined by said catch clear of said catch trough, said catch having a chisel portion with a ramp surface terminating at a chisel edge located on a terminal end, said chisel portion having an outward facing surface parallel to an inward facing surface, said catch having a grip surface protruding beyond said outward facing surface;

a spring held between said catch and said catch trough, said spring biases said catch towards said locked position;

when said tube portion of said main body is received by and affixed to said frame tube, said catch is constrained in said catch trough by an inside surface of said hollow frame tube;

a bracket for receiving and releasably connecting to said main body, said bracket having upstanding walls, said upstanding walls each having a pin aperture, said pin apertures aligning to form a pin axis, said pin apertures receiving a pin extending between and affixed to said pin apertures.

6. A bimini top comprising:

a first frame member having a first end pivotally connected to a first mounting bracket and pivotable about a first pivot point, said first frame member having a canopy support opposite said first end, said first frame member movable between a stored position and a use position, movement of said first frame member from said stored position to said use position being a forward direction of rotation;

a second frame member pivotally connected to said first frame member at a location between said first end of said first frame member and said canopy support of said first frame member, said second frame member having a canopy support opposite to said pivotal connection to said first frame member and said second frame member pivotable about a second pivot point, said second frame member movable between a stored position in which said second frame member at a first distance with respect to said first frame member and a use position in which said second frame member is at a second distance with respect to said first frame member, said second distance being greater than said first distance, movement of said second frame member from said stored position to said use position corresponding to rotation of said second frame member in said forward direction of rotation;

a third frame member pivotally connected to said first frame member at a location between said first end of said first frame member and said pivotal connection of said second frame member, said third frame member having a canopy support opposite said pivotal connection to said first frame member and said third frame member pivotable about a third pivot point, said third frame member movable between a stored position in which said third frame member is at a first distance with respect to said second frame member and a use position in which said third frame member is at a second distance with respect to said second frame member, said second distance being greater than said first distance, movement of said third frame member from said stored position to said use position corresponding to rotation of said third frame member in said forward direction of rotation;

an actuator including a screw rotatable within a base and restrained from axial movement, a threaded block engaging threads on said screw, an outer sheath connected to said base and said threaded block engaging said outer sheath to restrain said threaded block from rotation, said threaded block movable in axial sliding engagement with said outer sheath, rotation of said screw causing axial movement of said threaded block and movement of said actuator between a retracted and an extended position and a motor for rotating said screw, said actuator having a first end pivotally connected to a fixed location spaced from said pivotal connection of said first end of said first frame member to said first mounting bracket, said actuator having a second end pivotally connected to said third frame member at a location spaced from said pivotal connection of said third frame member to said first frame member, said actuator movable between a retracted position and an extended position, said extended position of said actuator corresponding to said stored position of said first, second, and third frame members wherein said first, second and third frame members are located at said first distances with respect to each other, said retracted position of said actuator corresponding to said use position of said first, second and third frame members; and a flexible connector connecting said first, second, and third frame members so that movement of said actuator from said extended position to retracted position pulls said third frame member into its said use position creating tension in said flexible connector, thereby pulling said second frame member into its said use position, movement of said second frame member into said use position creating tension in said flexible connector and thereby pulling said first frame member into its said use position.

7. The bimini top of claim 6, wherein said threaded block is connected to a screw sheath covering said screw, said threaded block and said screw sheath moving together as said threaded block moves along said screw.

8. The bimini top of claim 6, said flexible connector is a canopy wherein said canopy includes pockets surrounding said canopy supports.

9. The bimini top of claim 8, herein said first frame member has a center of gravity spaced from said first end in a location tending to rotate said first frame member in a direction opposite to said forward direction of rotation.

10. The bimini top of claim 8, wherein said first frame member includes a selectively disconnectable safety strut having a first end pivotally connected to said first frame member between said first end and said canopy support on an opposite side of said first member with respect to said second and third frame members, said safety strut having a second end further comprising:

an elongate hollow frame tube having a terminal end;

a main body having a hook portion and a tube portion, said hook portion having a transverse notch extending therethrough and having a depth, said main body having a central axis, said main body having a catch trough having a bottom surface extending from said tube portion and terminating at said transverse notch, said tube portion located in said terminal end of said hollow frame tube and having a retaining aperture extending therethrough;

a catch received by said catch trough, said catch slidable within said catch trough in a direction parallel to said central axis between a locked position and an unlocked position, said locked position defined by said catch interrupting said catch trough, said unlocked position defined by said catch clear of said catch trough, said catch having a chisel portion with a ramp surface terminating at a chisel edge located on a terminal end, said chisel portion having an outward facing surface parallel to an inward facing surface, said catch having a grip surface protruding beyond said outward facing surface;

a spring held between said catch and said catch trough, said spring biases said catch towards said locked position;

when said tube portion of said main body is received by and affixed to said frame tube, said catch is constrained in said catch trough by an inside surface of said hollow frame tube;

a bracket for receiving and releasably connecting to said main body, said bracket having upstanding walls, said upstanding walls each having a pin aperture, said pin apertures aligning to form a pin axis, said pin apertures receiving a pin extending between and affixed to said pin apertures.

11. A bimini top comprising:

a first frame member having a first end pivotally connected to a first mounting bracket and pivotable about a first pivot point, said first frame member having a canopy support opposite said first end, said first frame member movable between a stored position and a use position, movement of said first frame member from said stored position to said use position being a forward direction of rotation;

a second frame member pivotally connected to said first frame member at a location between said first end of said first frame member and said canopy support of said first frame member, said second frame member having a canopy support opposite to said pivotal connection to said first frame member and said second frame member pivotable about a second pivot point, said second frame member movable between a stored position in which said second frame member is at a first distance with respect to said first frame member and a use position in which said second frame member is at a second distance with respect to from said first frame member, said second distance being greater than said first distance, movement of said second frame member from said stored position to said use position corresponding to rotation of said second frame member in said forward direction of rotation;

a third frame member pivotally connected to said first frame member at a location between said first end of said first frame member and said pivotal connection of said second frame member, said third frame member having a canopy support opposite said pivotal connection to said first frame member and said third frame member pivotable about a third pivot point, said third frame member movable between a stored position in which said third frame member is at a first distance with respect to said second frame member and a use position in which said third frame member is at a second distance from said second frame member, said second distance being greater than said first distance, movement of said third frame member from said stored position to said use position corresponding to rotation of said third frame member in said forward direction of rotation;

an actuator including a screw rotatable within a base and restrained from axial movement, a threaded block engaging threads on said screw, an outer sheath connected to said base and said threaded block engaging said outer sheath to restrain said threaded block from rotation, said threaded block movable in axial sliding engagement with said outer sheath, rotation of said screw causing axial movement of said threaded block and movement of said actuator between a retracted and an extended position and a motor for rotating said screw, said actuator having a first end pivotally connected to a fixed location spaced from said pivotal connection of said first end of said first frame member to said first mounting bracket, said actuator having a second end pivotally connected to said third frame member at a location spaced from said pivotal connection of said third frame member to said first frame member, said actuator movable between a retracted position and an extended position, said extended position of said actuator corresponding to said stored position of said first, second, and third frame members wherein said first, second and third frame members are located at said first distances with respect to each other, said retracted position of said actuator corresponding to said use position of said first, second and third frame members; and a flexible canopy having pockets surrounding said canopy supports and said canopy connecting said first, second, and third frame members so that movement of said actuator from said extended position to retracted position pulls said third frame member into its said use position creating tension in said canopy, thereby pulling said second frame member into its said use position, movement of said second frame member into said use position creating tension in said flexible connector and thereby pulling said first frame member into its said use position.

12. The bimini top of claim 11, wherein said threaded block is connected to a screw sheath covering said screw, said threaded block and said screw sheath moving together as said threaded block moves along said screw.

13. The bimini top of claim 11, wherein said first frame member includes a selectively disconnectable safety strut having a first end pivotally connected to said first frame member between said first end and said canopy support on an opposite side of said first member with respect to said second and third frame members, said safety strut having a second end further comprising:

an elongate hollow frame tube having a terminal end;

a main body having a hook portion and a tube portion, said hook portion having a transverse notch extending therethrough and having a depth, said main body having a central axis, said main body having a catch trough having a bottom surface extending from said tube portion and terminating at said transverse notch, said tube portion located in said terminal end of said hollow frame tube and having a retaining aperture extending therethrough;

a catch received by said catch trough, said catch slidable within said catch trough in a direction parallel to said central axis between a locked position and an unlocked position, said locked position defined by said catch interrupting said catch trough, said unlocked position defined by said catch clear of said catch trough, said catch having a chisel portion with a ramp surface terminating at a chisel edge located on a terminal end, said chisel portion having an outward facing surface parallel to an inward facing surface, said catch having a grip surface protruding beyond said outward facing surface;

a spring held between said catch and said catch trough, said spring biases said catch towards said locked position;

when said tube portion of said main body is received by and affixed to said frame tube, said catch is constrained in said catch trough by an inside surface of said hollow frame tube;

a bracket for receiving and releasably connecting to said main body, said bracket having upstanding walls, said upstanding walls each having a pin aperture, said pin apertures aligning to form a pin axis, said pin apertures receiving a pin extending between and affixed to said pin apertures.

14. A bimini top comprising:

a first frame member having a first end pivotally connected to a first mounting bracket, said first frame member having a canopy support opposite said first end, said first frame member movable between a stored position and a use position, movement of said first frame member from said stored position to said use position being a forward direction of rotation;

a second frame member pivotally connected to said first frame member at a location between said first end of said first frame member and said canopy support of said first frame member, said second frame member having a canopy support opposite to said pivotal connection to said first frame member, said second frame member movable between a stored position in which said second frame member is at a first distance with respect to said first frame member and a use position in which said second frame member at a second distance with respect to said first frame member, said second distance being greater than said first distance, movement of said second frame member from said stored position to said use position corresponding to rotation of said second frame member in said forward direction of rotation;

a third frame member pivotally connected to said first frame member at a location between said first end of said first frame member and said pivotal connection of said second frame member, said third frame member having a canopy support opposite said pivotal connection to said first frame member, said third frame member movable between a stored position in which said third frame member is at a first distance with respect to said second frame member and a use position in which said third frame member is at a second distance with respect to said second frame member, said second distance being greater than said first distance, movement of said third frame member from said stored position to said use position corresponding to rotation of said third frame member in said forward direction of rotation;

an actuator having a first end pivotally connected to a fixed location spaced from said pivotal connection of said first end of said first frame member to said first mounting bracket, said fixed location of said first end of said actuator fixed from movement with respect to said first end of said first frame member, said actuator having a second end pivotally connected to said third frame member at a location spaced from said pivotal connection of said third frame member to said first frame member, said actuator movable between a retracted position and an extended position, said retracted position locating said first end and said second end of said actuator at a first distance from each other and said extended position locating said first and said second end of said actuator at a second distance from each other said second distance being greater than said first distance, said extended position of said actuator corresponding to said stored position of said first, second, and third frame members wherein said first, second and third frame members are located at said first distances with respect to each other, said retracted position of said actuator corresponding to said use position of said first, second and third frame members; and a flexible connector connecting said first, second, and third frame members so that movement of said actuator from said extended position to retracted position pulls said second and third frame members into said use position.

* * * * *